US011390433B2

(12) United States Patent
Moskovich

(10) Patent No.: US 11,390,433 B2
(45) Date of Patent: Jul. 19, 2022

(54) CONTAINER

(71) Applicant: Colgate-Palmolive Company, New York, NY (US)

(72) Inventor: Robert Moskovich, Manakin-Sabot, VA (US)

(73) Assignee: Colgate-Palmolive Company, New York, NY (US)

( * ) Notice: Subject to any disclaimer, the term of this patent is extended or adjusted under 35 U.S.C. 154(b) by 479 days.

(21) Appl. No.: 16/341,093

(22) PCT Filed: Oct. 14, 2016

(86) PCT No.: PCT/US2016/057096

§ 371 (c)(1),
(2) Date: Apr. 11, 2019

(87) PCT Pub. No.: WO2018/071040

PCT Pub. Date: Apr. 19, 2018

(65) Prior Publication Data

US 2020/0189809 A1 Jun. 18, 2020

(51) Int. Cl.
*B65D 47/08* (2006.01)
*B65D 1/32* (2006.01)

(52) U.S. Cl.
CPC ..... *B65D 47/0838* (2013.01); *B65D 1/32* (2013.01); *B65D 2251/1025* (2013.01)

(58) Field of Classification Search
CPC .... B65D 47/0838; B65D 1/32; B65D 43/161; B65D 51/18; B65D 2251/1025
(Continued)

(56) References Cited

U.S. PATENT DOCUMENTS 4,462,504 A * 7/1984 Roth ..... B65D 47/0838 220/214
4,496,069 A * 1/1985 Winkless ..... B65D 47/0838 220/260

(Continued)

FOREIGN PATENT DOCUMENTS

CN 104603025 5/2015
CN 105473460 4/2016

(Continued)

OTHER PUBLICATIONS

International Search Report and Written Opinion of the International Searching Authority in International Application No. PCT/US2016/057096, dated Apr. 13, 2017.

*Primary Examiner* — Shawn M Braden

(57) ABSTRACT

A container (100) includes a body (110) defining an internal volume and a first opening (112) that provides a path of fluid communication between the internal volume and an exterior of the body. A nozzle piece (120) is positioned at least partially within the opening in the body. The nozzle piece defines a second opening (126) that is smaller than the first opening in the body. A cap piece (130) is integral with the body. The cap piece is configured to pivot between an open position and a closed position via a hinge (132) that is positioned between the body and the cap piece. Fluid flow is permitted through the second opening in the nozzle piece when the cap piece is in the open position, and the cap piece prevents fluid flow through the second opening in the nozzle piece when the cap piece is in the closed position.

7 Claims, 12 Drawing Sheets

(58) Field of Classification Search
USPC ..... 215/235
See application file for complete search history.

(56) References Cited

U.S. PATENT DOCUMENTS

| | | | | |
|---|---|---|---|---|
| 4,513,914 | A | 4/1985 | Cook | |
| 4,519,517 | A * | 5/1985 | Walter | B65D 55/02 215/209 |
| 4,592,480 | A * | 6/1986 | Hart | B65D 55/06 220/270 |
| 5,662,245 | A * | 9/1997 | Grant | B29C 45/0081 222/153.07 |
| 6,550,626 | B1 * | 4/2003 | Randall | B65D 41/3442 215/253 |
| 7,021,482 | B2 * | 4/2006 | Solowiejko | B65D 47/0847 220/254.2 |
| 7,114,627 | B2 * | 10/2006 | Solowiejko | B65D 47/0847 220/254.2 |
| 7,334,694 | B2 | 2/2008 | Suffa | |
| 7,845,519 | B2 * | 12/2010 | Newberry | B65D 47/0838 222/153.07 |
| 9,371,162 | B2 * | 6/2016 | Walunis | B65D 47/0847 |
| 2004/0168690 | A1 * | 9/2004 | Payne | B29C 45/1676 128/207.14 |
| 2007/0241108 | A1 * | 10/2007 | Rushe | B65D 77/0473 220/257.2 |
| 2008/0230543 | A1 * | 9/2008 | Kick | B65D 47/0838 220/254.3 |
| 2010/0084399 | A1 * | 4/2010 | Shieh | B65D 47/0838 220/265 |
| 2010/0102022 | A1 * | 4/2010 | Kuwahara | B65D 47/0814 215/235 |
| 2012/0241454 | A1 * | 9/2012 | Dennis | B65D 47/088 220/259.2 |
| 2014/0224802 | A1 * | 8/2014 | Gonnert | B29C 45/0017 220/265 |
| 2016/0023818 | A1 | 1/2016 | Gelov et al. | |
| 2016/0068313 | A1 * | 3/2016 | Hart | B65D 43/169 220/254.2 |

FOREIGN PATENT DOCUMENTS

| | | |
|---|---|---|
| EP | 0689999 | 2/1996 |
| WO | 2000/046119 | 8/2000 |
| WO | 2014/172419 | 10/2014 |

* cited by examiner

CONTAINER

BACKGROUND

Containers include a body that defines an internal volume and an opening that provides a path of fluid communication between the internal volume and an exterior of the body. A consumer product is introduced (e.g., poured) into the internal volume through the opening. Once the consumer product is in the internal volume, a lid is screwed onto the body proximate to the opening. Some lids completely seal the opening in the body. Other lids have a smaller opening formed therethrough (e.g., a nozzle) that provides a path of fluid communication through which the consumer product may be dispensed from the internal volume. In the embodiment where the lid includes the smaller opening, the lid may have a cap coupled thereto that pivots between an open position and a closed position. The cap seals the smaller opening in the lid when in the closed position.

Users oftentimes find it a nuisance to have to unscrew the lid from the body to refill the internal volume. In addition, the consumer product may leak from the internal volume if the lid is not screwed tightly to the body. What is desirable is an improved container.

BRIEF SUMMARY

A container is disclosed. The container includes a body defining an internal volume and a first opening that provides a path of fluid communication between the internal volume and an exterior of the body. A nozzle piece is positioned at least partially within the opening in the body. The nozzle piece defines a second opening that is smaller than the first opening in the body. A cap piece is integral with the body. The cap piece is configured to pivot between an open position and a closed position via a hinge that is positioned between the body and the cap piece. Fluid flow is permitted through the second opening in the nozzle piece when the cap piece is in the open position, and the cap piece prevents fluid flow through the second opening in the nozzle piece when the cap piece is in the closed position.

A preform is also disclosed. The preform includes a body defining an internal volume and a first opening that provides a path of fluid communication between the internal volume and an exterior of the body. A nozzle piece is configured to be positioned at least partially within the opening in the body. The nozzle piece defines a second opening that is smaller than the first opening in the body. A cap piece is integral with the body. The cap piece is configured to pivot between an open position and a closed position via a hinge that is positioned between the body and the cap piece. Fluid flow is permitted through the second opening in the nozzle piece when the cap piece is in the open position, and the cap piece prevents fluid flow through the second opening in the nozzle piece when the cap piece is in the closed position.

In another embodiment, the container includes a body defining an internal volume and a first opening that provides a path of fluid communication between the internal volume and an exterior of the body. The container also includes a cap piece that is configured to pivot between an open position and a closed position. The container also includes a nozzle piece that is configured to pivot between an open position and a closed position. The nozzle piece defines a second opening that is smaller than the first opening in the body.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawing, wherein.

DETAILED DESCRIPTION

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Figure 1:
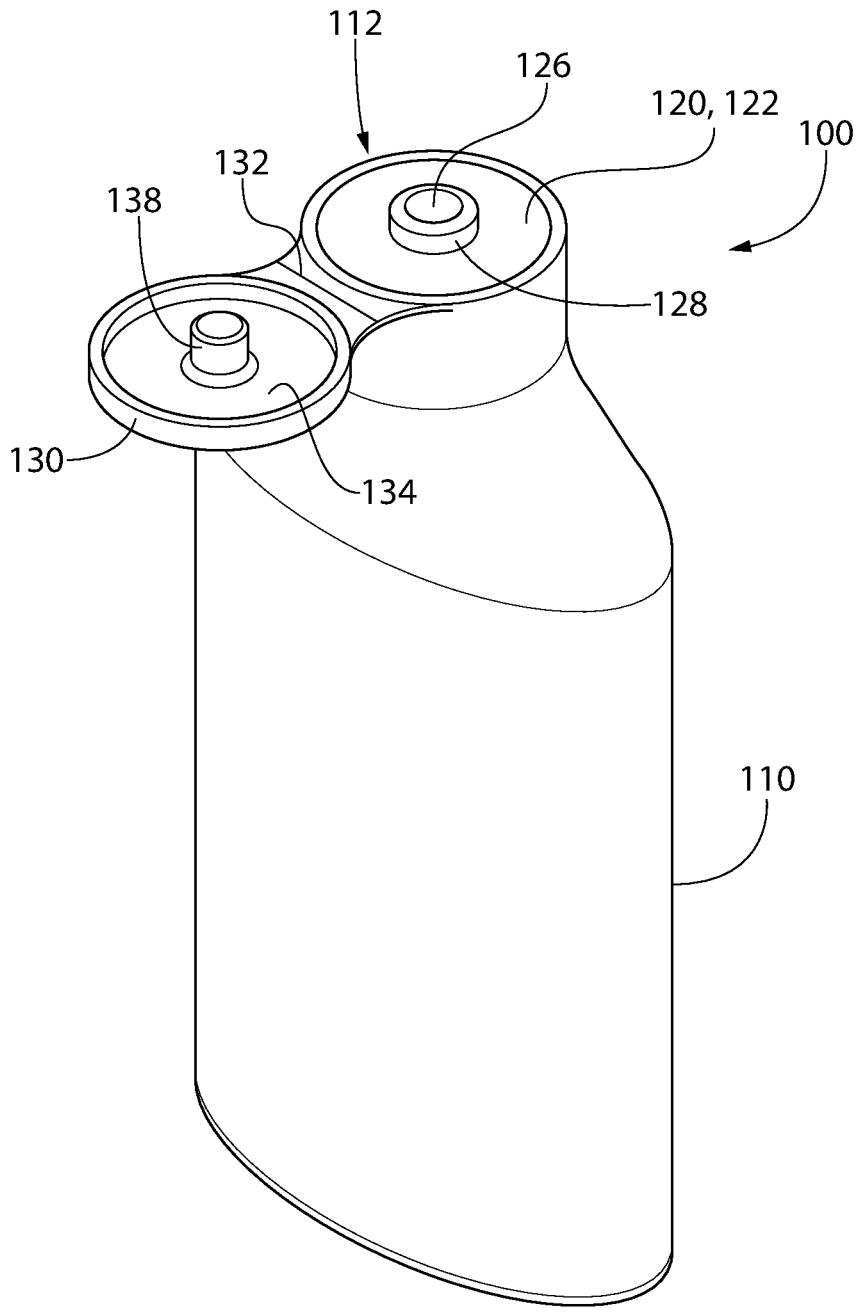
FIG. 1 depicts a perspective view of an example of a container that is consistent with the invention.
Figure 2:
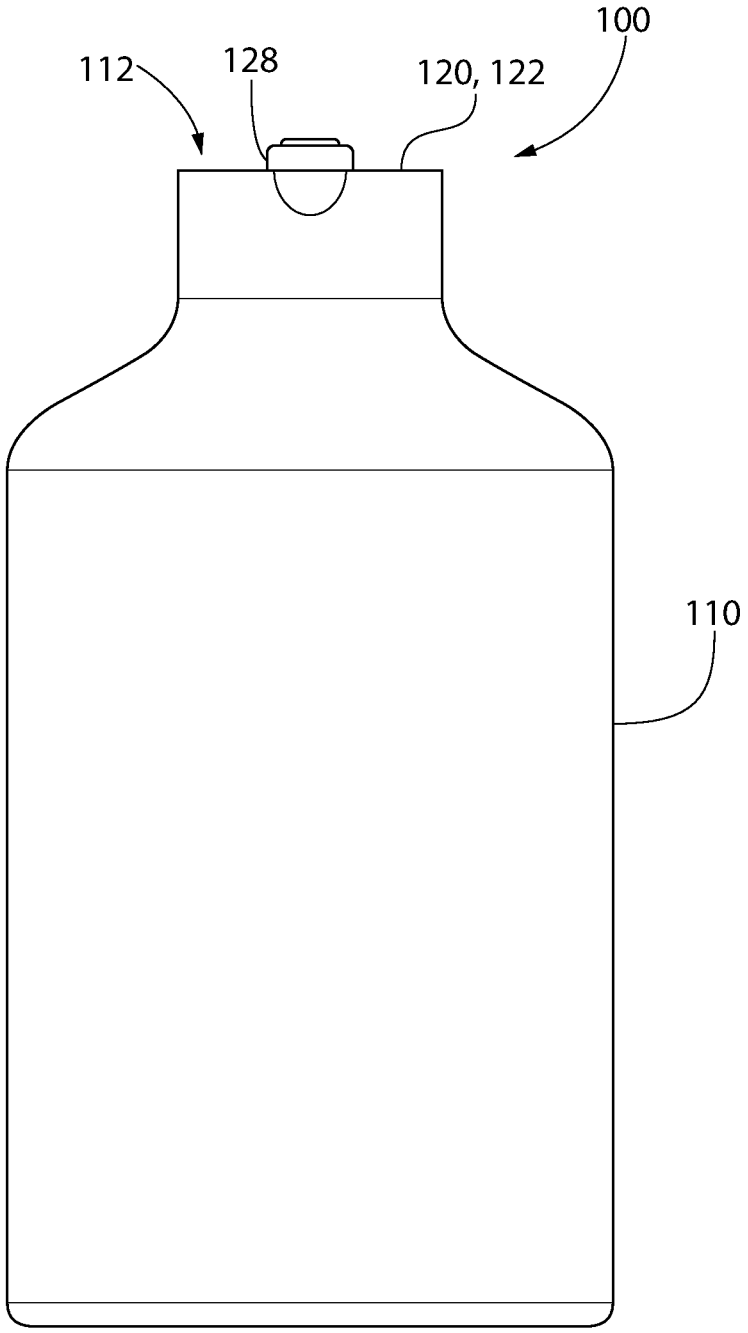
FIG. 2 depicts a front view of the container shown in FIG. 1.
Figure 3:
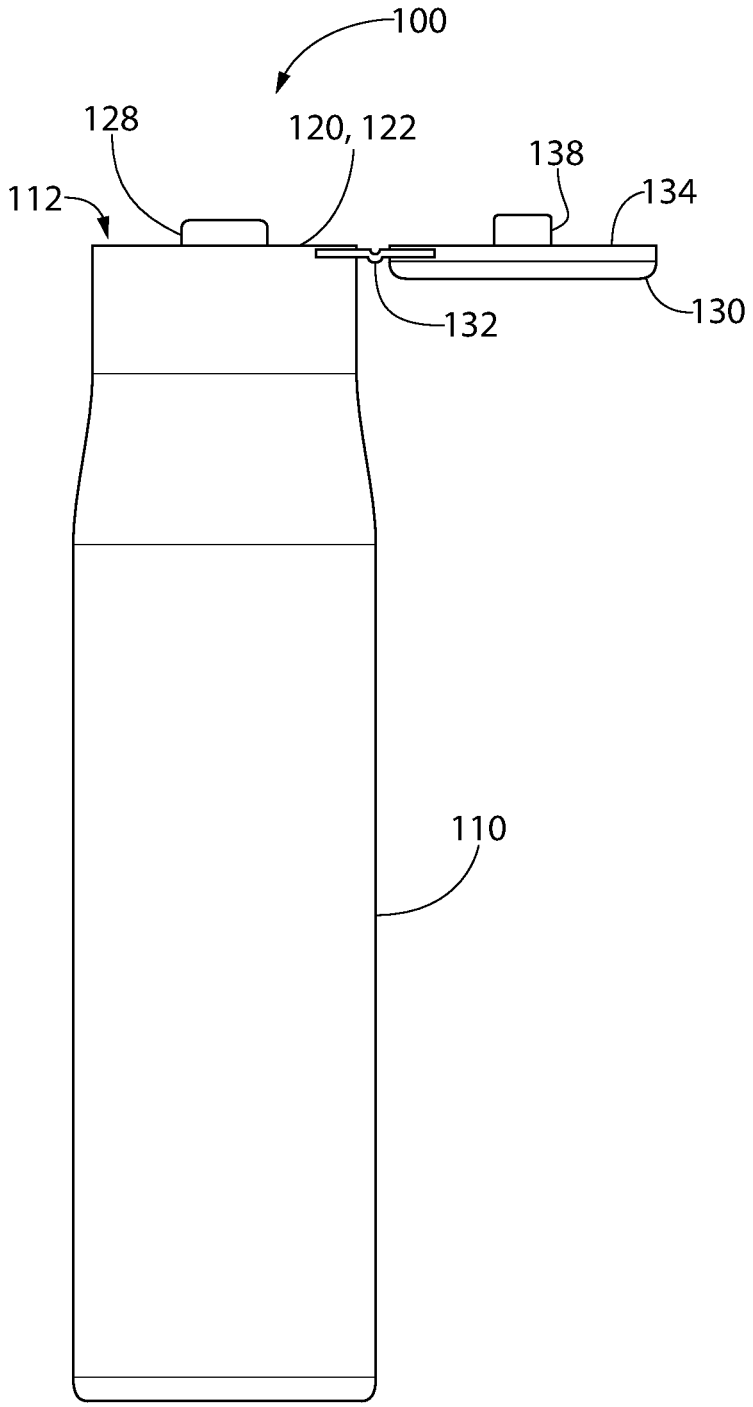
FIG. 3 depicts a side view of the container shown in FIG. 1.

FIGS. 1-3 depict a perspective view, a front view, and a side view of an example of a container 100. The container 100 may include a body 110 that defines an internal volume. The body 100 may define an opening 112 that provides a path of fluid communication between the internal volume and an exterior of the body 110.

The container 100 may also include a nozzle piece 120. The nozzle piece 120 may be inserted at least partially into the body 110 (e.g., into the opening 112 in the body 110). The nozzle piece 120 may be coupled to the inner surface of the body 110 via a threaded engagement, a friction fit, a snap fit, an adhesive, or the like. For example, an exterior (e.g., radial) surface of the nozzle piece 120 may have threads that are configured to engage corresponding threads on the interior (e.g., radial) surface of the opening 112 of the body 110. In another example, the exterior surface of the nozzle piece 120 may include a (e.g., radial) protrusion that is configured to snap into a (e.g., radial) groove formed in the inner surface of the opening 112 of the body 110.

The nozzle piece 120 may include a substantially planar outer surface 122 and a substantially planar inner surface (not shown). An opening 126 may be formed through the nozzle piece 120 providing a path of fluid communication between the outer surface 122 and the inner surface. The opening 126 in the nozzle piece 120 may be aligned with the opening 112 in the body 110 when the nozzle piece 120 is inserted into and/or coupled with the body 110. The opening 126 in the nozzle piece 120 may have a smaller cross-sectional area (e.g., diameter) than the opening 112 in the body 110. As such, the nozzle piece 120 may provide a restricted flow path between the internal volume and the exterior of the body 110. A hollow protrusion 128 may extend upward from the outer surface 122 of the nozzle piece 120 and/or downward from the inner surface of the nozzle piece 120. The protrusion 128 may be substantially cylindrical and have the opening 126 extending therethrough.

The container 100 may also include a cap piece 130. The cap piece 130 may be coupled to or integral with the body 110. More particularly, the cap piece 130 may be coupled to or integral with the body 110 via a hinge 132. The hinge 132 may enable the cap piece 130 to pivot between an open position (as shown in FIG. 1) and a closed position with respect to the body 110. In the open position, fluid is permitted to flow through the opening 112 in the body 110 and/or the opening 126 in the nozzle piece 120. In the closed position, the cap piece 130 may plug or otherwise close the opening 112 in the body 110 and/or the opening 126 in the nozzle piece 120. More particularly, a protrusion 138 may extend from an inner surface 134 of the cap piece 130, and the protrusion 138 may plug the opening 126 in the nozzle piece 120 when the cap piece 130 is in the closed position.

Figure 4:
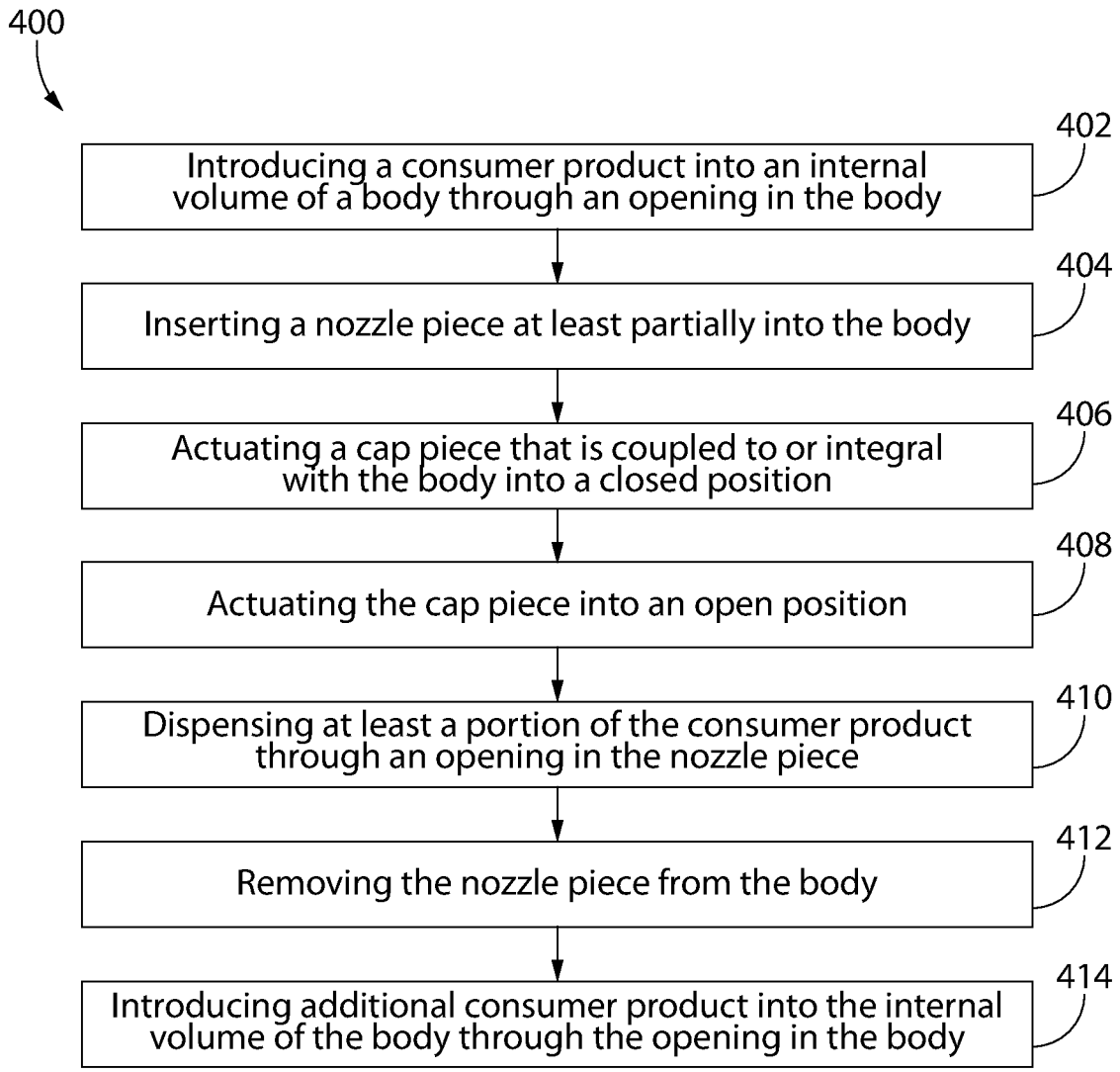
FIG. 4 depicts a flowchart of an example of a method for using the container shown in FIG. 1.

FIG. 4 illustrates a flowchart of an example of a method 400 for using the container 100. The method 400 may begin by introducing (e.g., pouring or injecting) a consumer product into the internal volume of the body 110 through the opening 112 in the body 110, as at 402. The consumer product may be or include toothpaste, mouthwash, shampoo, conditioner, household cleaning products, food products (e.g., ketchup, mustard, mayonnaise, etc.), or the like. The method 400 may also include inserting the nozzle piece 120 at least partially into the body 110 after the consumer product is introduced into the internal volume, as at 404. Inserting the nozzle piece 120 at least partially into the body 110 may include inserting the nozzle piece 120 into the opening 112 in the body 110 and coupling the nozzle piece 120 to the inner surface of the body 110 (e.g., an inner surface of the opening 112). The method 400 may also include actuating the cap piece 130 into the closed position, as at 406. The cap piece 130 may remain in the closed position while access to the consumer product is not needed, for example, when the container 100 is being transported to a store, when the container 100 is on a shelf at the store, when the container 100 is being transported to a user's home, etc. The nozzle piece 120 may be inserted into and/or coupled with the body 110 before the cap piece 130 is actuated into the closed position (as described above) or after the cap piece 130 is actuated back into the open position.

The method 400 may also include actuating the cap piece 130 into the open position, as at 408. The method 400 may also include dispensing at least a portion of the consumer product through the opening 126 in the nozzle piece 120, as at 410. The method 400 may also include removing the nozzle piece 120 from the body 110, as at 412, and introducing additional consumer product into the internal volume of the body 110 through the opening 112 in the body 110, as at 414. In such embodiments, a consumer may refill the container 100 with the consumer product, and then reinsert the nozzle piece 120, as at 404.

Although the foregoing description uses reference number 120 to refer to the nozzle piece and reference number 130 to refer to the cap piece, in another embodiment, reference number 120 may refer to the cap piece, and reference number 130 may refer to the nozzle piece. In this embodiment, the cap piece may be inserted at least partially into the body 110 and/or coupled with the body 110 when the container is not being used to dispense the consumer product. When the user wants to dispense the consumer product, the consumer may remove the cap piece and actuate (e.g., rotate around the hinge 132) the nozzle piece into the closed position to align the opening in the nozzle piece with the opening in the body 110.

Figure 5:
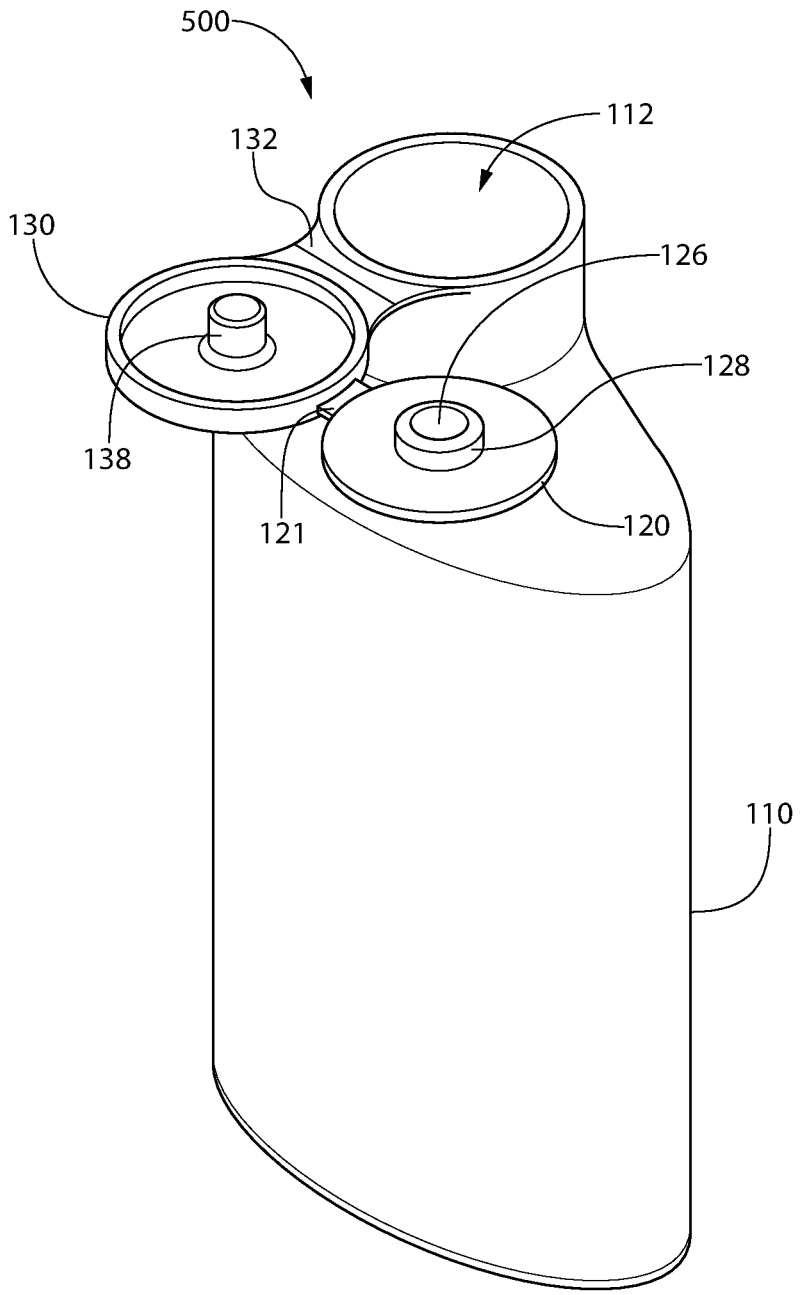
FIG. 5 depicts a perspective view of another example of a container.
Figure 6:
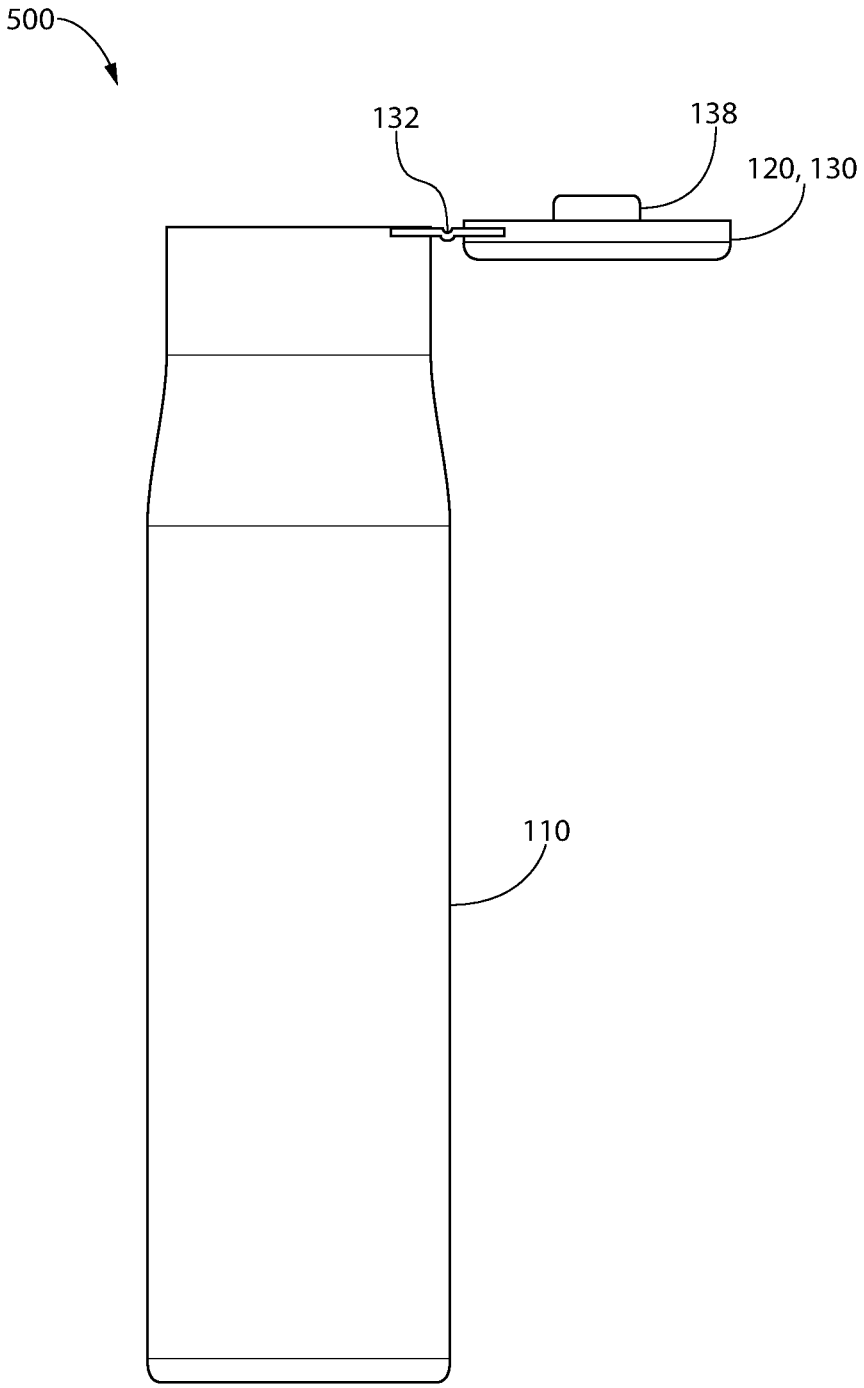
FIG. 6 depicts a side view of the container shown in FIG. 5.

FIGS. 5 and 6 illustrate a perspective view and a side view of another example of a container 500. The container 500 may be similar in some respects to the container 100, and the same reference numbers are used where appropriate. For example, the container 500 may include the body 110, the nozzle piece 120, and the cap piece 130. The nozzle piece 120 may be coupled to or integral with the cap piece 130 via a hinge 121. The hinge 121 may enable the nozzle piece 120 to pivot between a first position (as shown in FIGS. 5 and 6) and a second position with respect to the cap piece 130. In the first position, the nozzle piece 120 may be clear of (i.e., not inserted into) the cap piece 130. In the second position, the nozzle piece 120 may folded at least partially into and/or on top of the cap piece 130. More particularly, the opening 126 in the nozzle piece 120 may receive the protrusion 138 of the cap piece 130.

The cap piece 130 may be coupled to or integral with the body 110 via a hinge 132. The hinge 132 may enable the cap piece 130 to pivot between an open position (as shown in FIGS. 5 and 6) and a closed position with respect to the body 110. In the open position, the cap piece 130 may be clear of (i.e., not inserted into) the body 110. In the closed position, the cap piece 130 may be inserted at least partially into the opening 112 of the body 110 to prevent any fluid from flowing through the opening 112 in the body 110. The cap piece 130 may be configured to pivot between the open position and the closed position independent of the position of the nozzle piece 120.

In the embodiments shown in FIGS. 5 and 6, the nozzle piece 120 may pivot in a first direction, and the cap piece 130 may pivot in a second direction that is substantially perpendicular to the first direction. In another embodiment (not shown), the nozzle piece 120 and the cap piece 130 may pivot in the same direction. In at least one embodiment, the body 110, the nozzle piece 120, the hinge 121, the cap piece 130, and the hinge 132 may be a single, integral component. For example, the body 110, the nozzle piece 120, the hinge 121, the cap piece 130, and the hinge 132 may be blow-molded.

Figure 7:
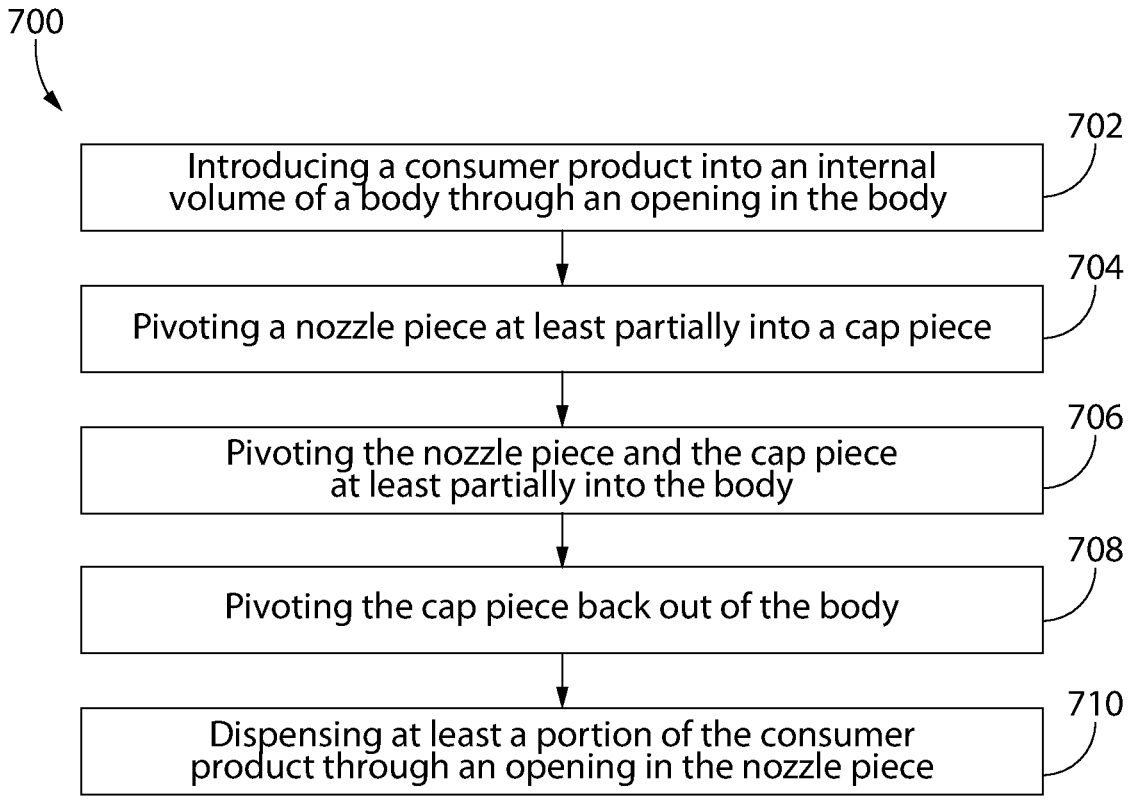
FIG. 7 depicts a flowchart of a method for using the container shown in FIGS. 5 and 6.

FIG. 7 depicts a flowchart of an example of a method 700 for using the container 500. The method 700 may begin by introducing (e.g., pouring) a consumer product into the internal volume of the body 110 through the opening 112 in the body 110, as at 702. The method 700 may also include pivoting the nozzle piece 120 into the second position (e.g., at least partially into the cap piece 130), as at 704. The method 700 may also include pivoting the cap piece 130 into the closed position, as at 706. The nozzle piece 120 may move together with the cap piece 130 at least partially into the opening 112 of the body 110 when the cap piece 130 pivots into the closed position. The method 700 may also include pivoting the cap piece 130 into the open position, as at 708.

The hinge 121 between the nozzle piece 120 and the cap piece 130 may break, allowing the nozzle piece 120 to separate from the cap piece 130 either before the nozzle piece 120 is pivoted into the cap piece 130, when the nozzle piece 120 is pivoted into the cap piece 130, when the cap piece 130 pivots into the closed position, or when the cap piece 130 pivots back into the open position. As a result, the nozzle piece 120 may remain positioned within the opening 112 in the body 110 when the cap piece 130 pivots back into the open position. The method 700 may also include dispensing at least a portion of the consumer product through the opening 126 in the nozzle piece 120, as at 710.

Figure 8:
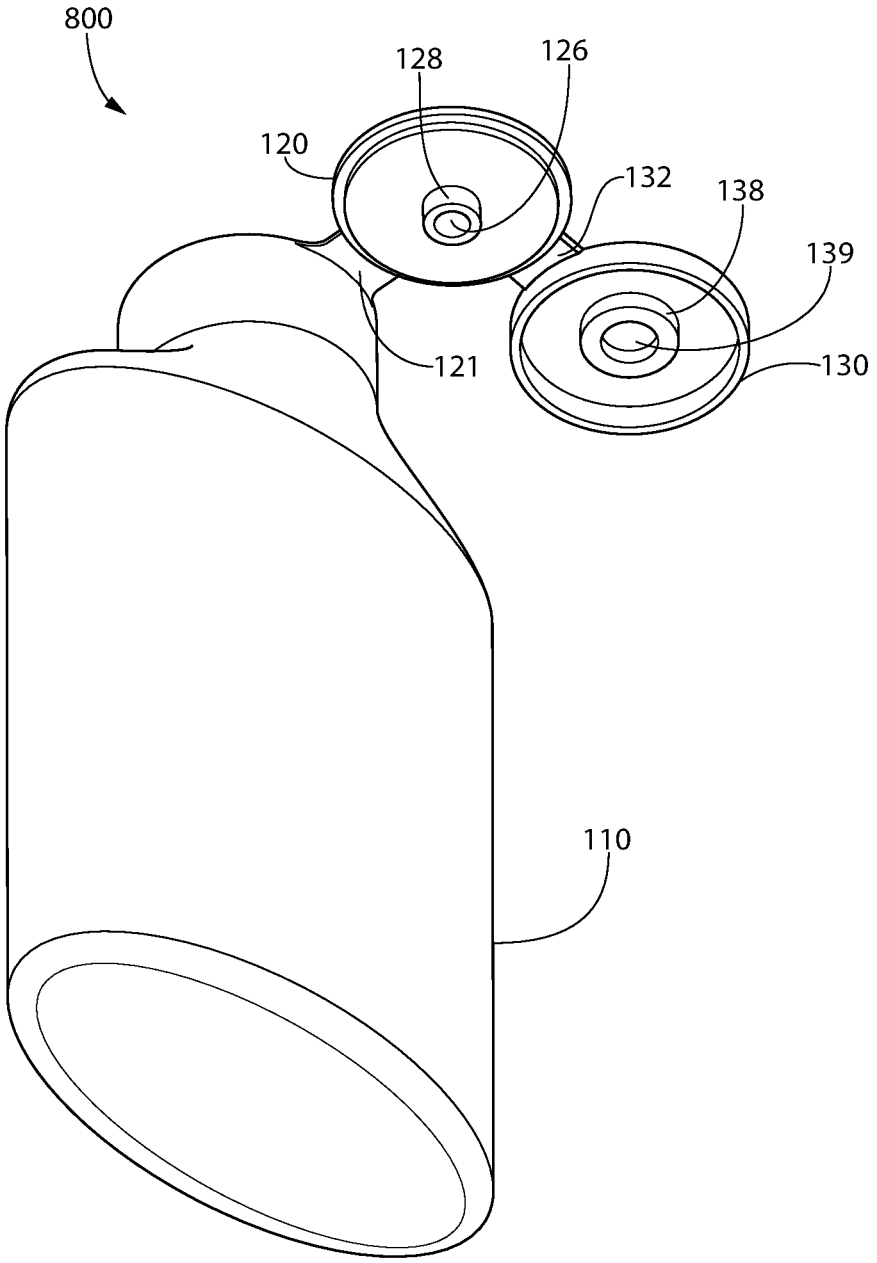
FIG. 8 depicts a perspective view of another example of a container.
Figure 9:
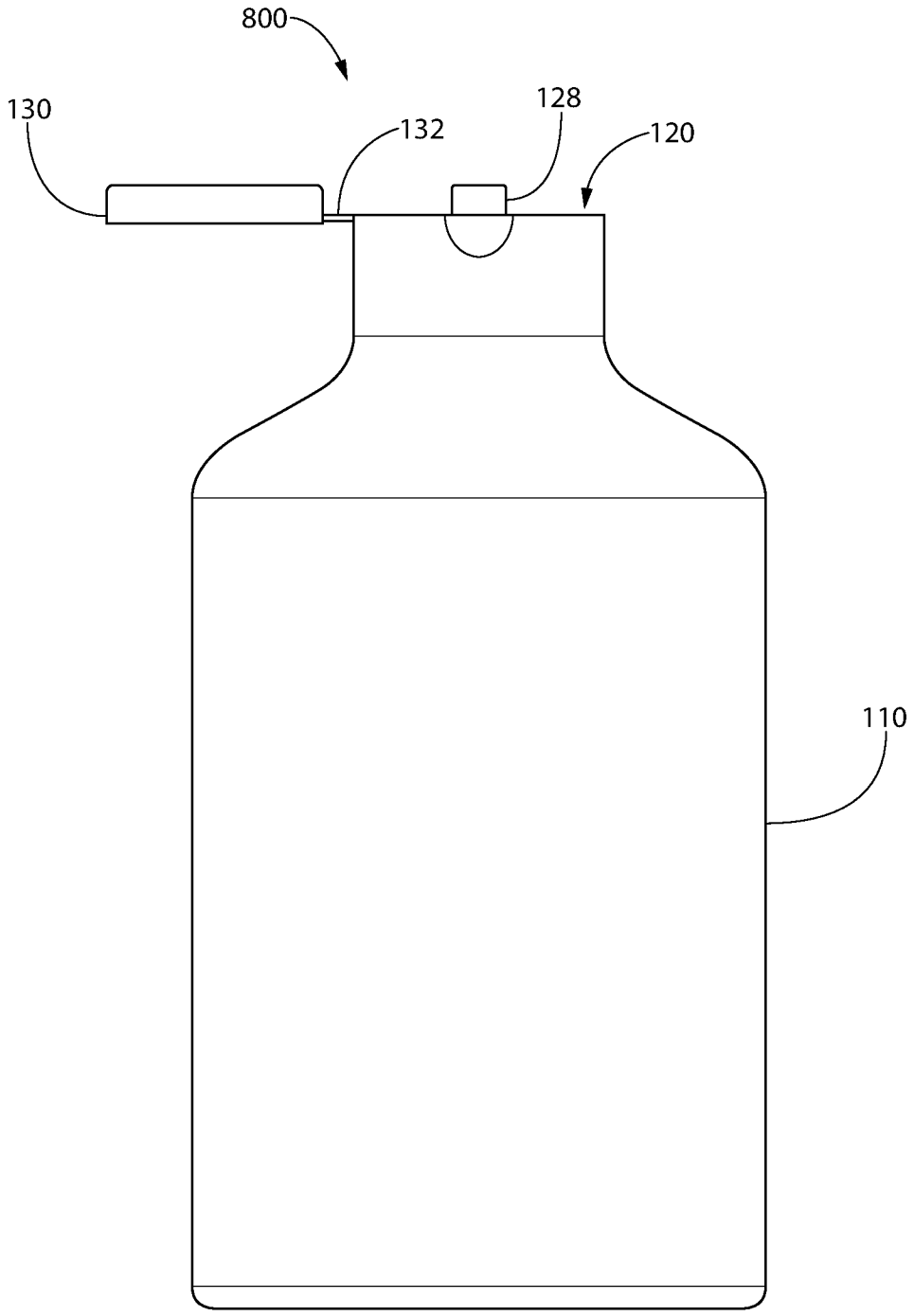
FIG. 9 depicts a front view of the container shown in FIG. 8.

FIGS. 8 and 9 depict a perspective view and a side view of another example of a container 800. The container 800 may be similar in some respects to the containers 100 and 500, and the same reference numbers are used where appropriate. For example, the container 800 may include the body 110, the nozzle piece 120, and the cap piece 130. The nozzle piece 120 may be coupled to or integral with the body 110 via the hinge 121. The hinge 121 may enable the nozzle piece 120 to pivot between an open position (as shown in FIGS. 8 and 9) and a closed position with respect to the body 110. In the open position, the nozzle piece 120 is clear of (i.e., not inserted into) the body 110, and the opening 126 in the nozzle piece 120 is misaligned with the opening 112 in the body 110. In the closed position, the nozzle piece 120 is inserted at least partially into the opening 112 of the body 110, and the opening 126 in the nozzle piece 120 is aligned with the opening 112 in the body 110. The nozzle piece 120 may be configured to pivot between the open position and the closed position independent of the position of the cap piece 130.

The cap piece 130 may be coupled to or integral with the nozzle piece 120 via the hinge 132. In at least one embodiment, the body 110, the nozzle piece 120, the hinge 121, the cap piece 130, and the hinge 132 may be a single, integral component. The hinge 132 may enable the cap piece 130 to pivot between an open position (as shown in FIGS. 8 and 9) and a closed position with respect to the nozzle piece 120. In the open position, fluid is permitted to flow through the opening 112 in the body 110 and/or the opening 126 in the nozzle piece 120. In the closed position, the cap piece 130 may plug or otherwise close the opening 112 in the body 110 and/or the opening 126 in the nozzle piece 120. More particularly, the protrusion 128 of the nozzle piece 120 may be received within a recess 139 formed in the protrusion 138 of the cap piece 130 to seal the opening 126 in the nozzle piece 120 when the cap piece 130 is in the closed position. In some embodiments, the cap piece 130 may be configured to pivot between the open position and the closed position independent of the position of the nozzle piece 120. In such embodiments, the cap piece 130 may rotate either clockwise or counter clockwise around the hinge 132 from the perspective shown in FIG. 8. In another embodiment, the cap piece 130 may only be pivoted between the open position and the closed position when the nozzle piece 120 is in the closed position. In such embodiments, the cap piece 130 must rotate clockwise around the hinge 132 from the perspective shown in FIG. 8 in order to operate correctly.

In the embodiments shown in FIGS. 8 and 9, the nozzle piece 120 may pivot in a first direction, and the cap piece 130 may pivot in a second direction that is substantially perpendicular to the first direction. In another embodiment (not shown), the nozzle piece 120 and the cap piece 130 may pivot in the same direction.

Figure 10:
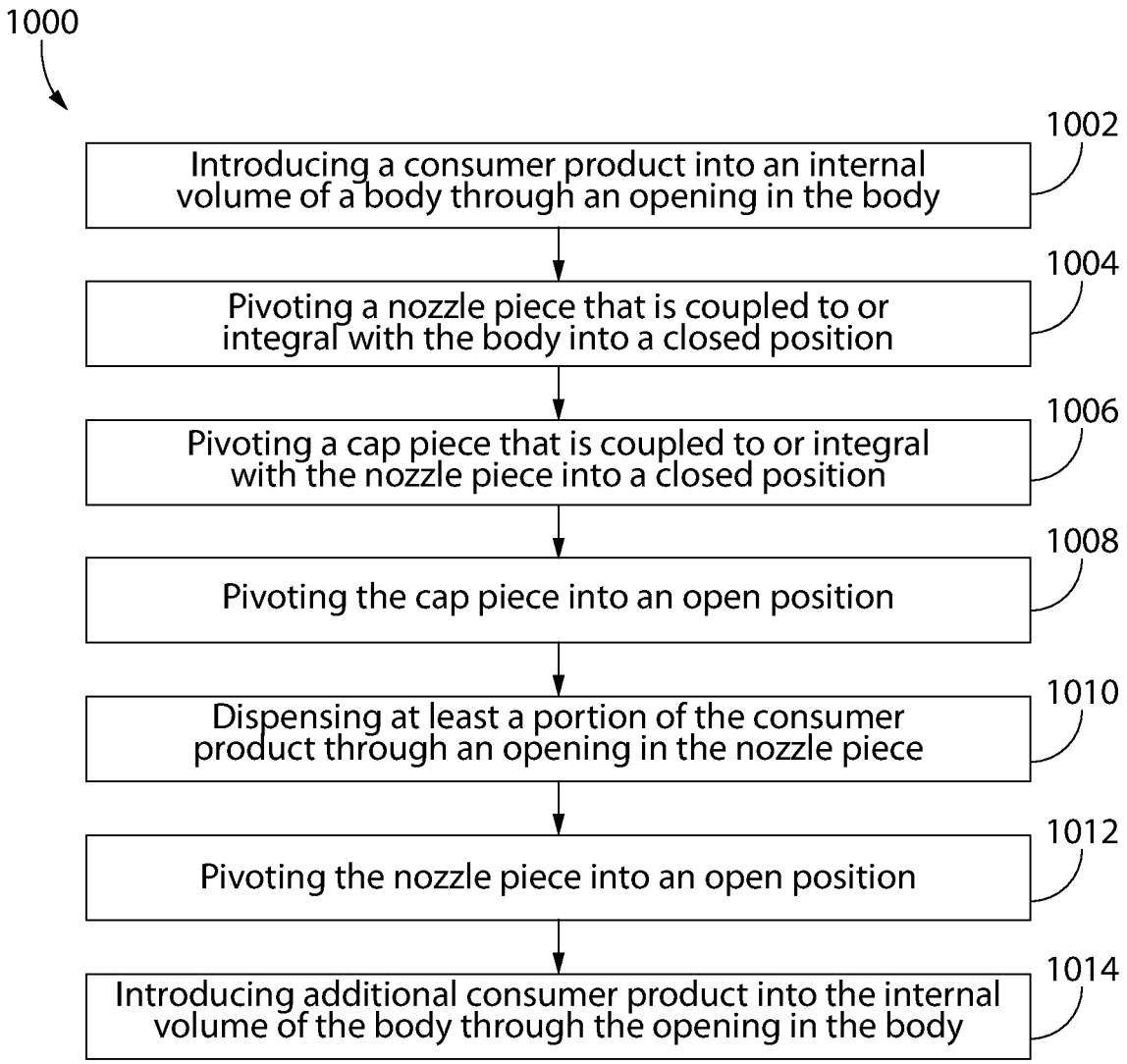
FIG. 10 depicts a flowchart of a method for using the container shown in FIGS. 8 and 9.

FIG. 10 depicts a flowchart of an example of a method 1000 for using the container 800. The method 1000 may begin by introducing (e.g., pouring) a consumer product into the internal volume of the body 110 through the opening 112 in the body 110, as at 1002. The method 1000 may also include pivoting the nozzle piece 120 into the closed position, as at 1004. The nozzle piece 120 may be pivoted into the closed position after the consumer product is introduced into the internal volume. The method 1000 may also include pivoting the cap piece 130 into the closed position, as at 1006. The cap piece 130 may be pivoted into the closed position before or after the nozzle piece 120 is pivoted into the closed position, in various embodiments. The method 1000 may also include pivoting the cap piece 130 into the open position, as at 1008. The method 900 may also include dispensing at least a portion of the consumer product through the opening 126 in the nozzle piece 120, as at 1010. The method 1000 may also include pivoting the nozzle piece 120 into the open position after at least a portion of the consumer product is dispensed, as at 1012. The method 1000 may also include introducing additional consumer product into the internal volume of the body 110 through the opening 112 in the body 110 when the nozzle piece 120 is in the open position, as at 1014. In such embodiments, a consumer may refill the container 800 with more of the consumer product, and then pivot the nozzle piece 120 back into place before dispensing, as at 1004.

Figure 11:
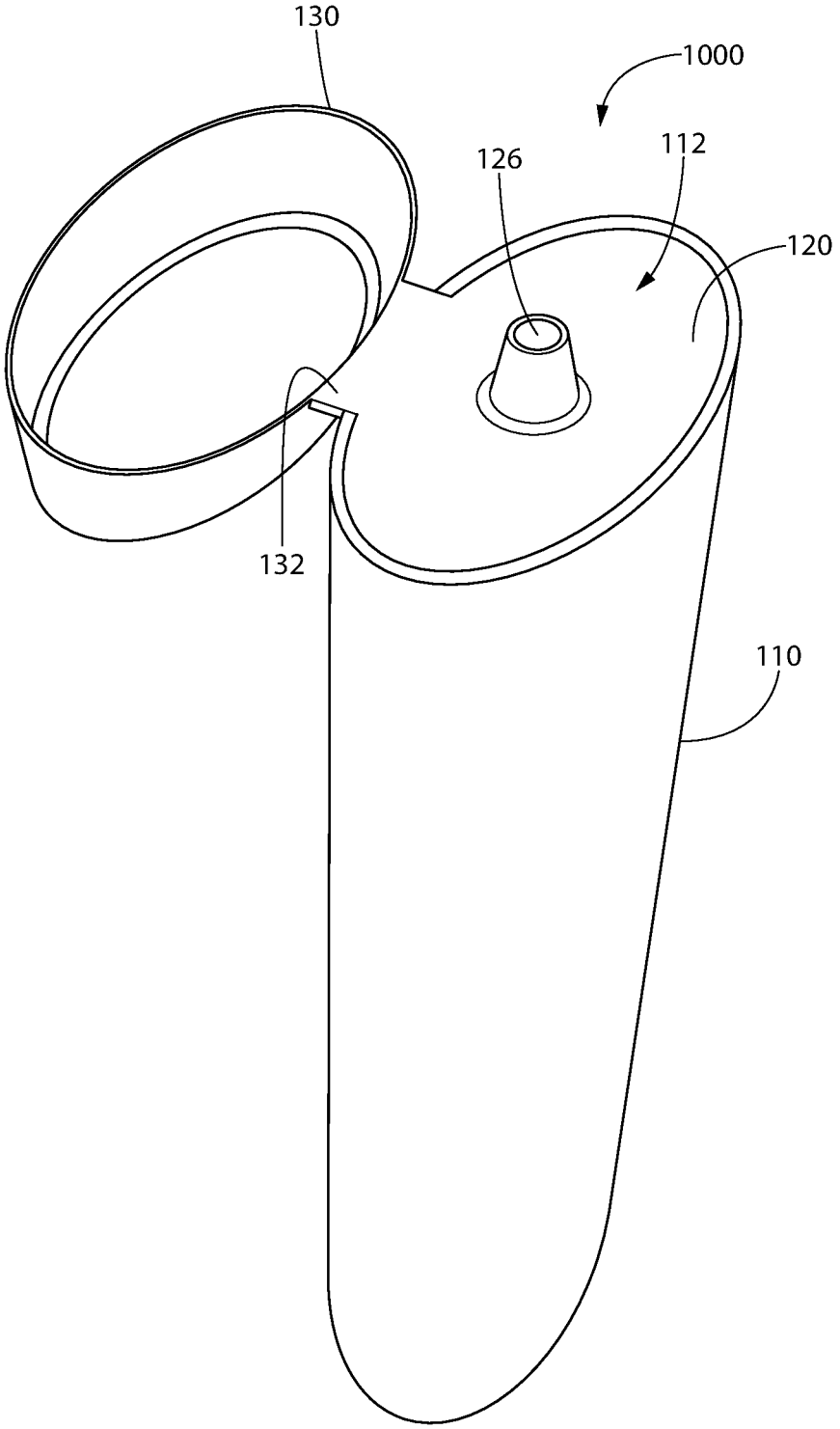
FIG. 11 depicts a perspective view of yet another example of a container.

FIG. 11 depicts a perspective view of another example of a container 1100. The container 1000 may be similar in some respects to the containers 100, 500, and 800, and the same reference numbers are used where appropriate. For example, the container 100 may include the body 110, the nozzle piece 120, and the cap piece 130. The nozzle piece 120 may be inserted at least partially into the body 110 (e.g., into the opening 112 in the body 110). The nozzle piece 120 may be coupled to the inner surface of the body 110 via a threaded engagement, a friction fit, a snap fit, an adhesive, or the like.

The cap piece 130 may be coupled to or integral with the body 110 and/or the nozzle piece 120 via the hinge 132. The hinge 132 may enable the cap piece 130 to pivot around the hinge 132 between an open position (as shown in FIG. 11) and a closed position with respect to the nozzle piece 120. In the open position, fluid is permitted to flow through the opening 112 in the body 110 and/or the opening 126 in the nozzle piece 120. In the closed position, the cap piece 130 may plug or otherwise close the opening 112 in the body 110 and/or the opening 126 in the nozzle piece 120.

Figure 12:
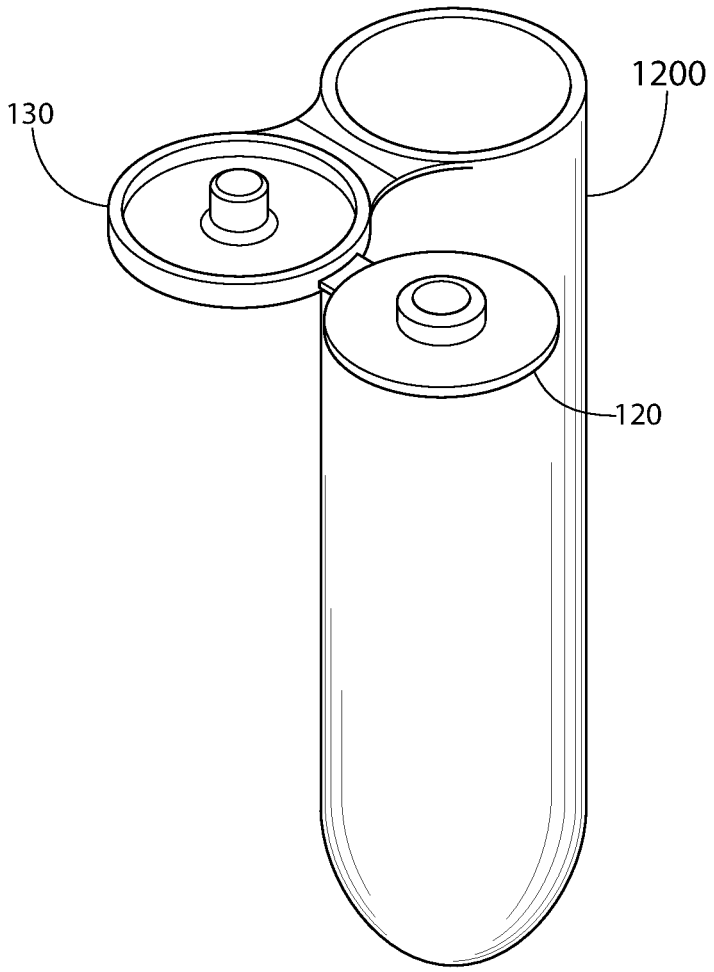
FIG. 12 depicts a side view of an example of a preform that may be used to form the body of the container.

FIG. 12 depicts a side view of an example of a preform 1200 that may be used to form the body 110 of the container 100. The preform 1200 may have a thickness from about 0.05 mm to about 5 mm or from about 0.1 mm to about 3 mm. In at least one embodiment, the preform 1200 may include one or more over-molded portions/layers. The preform 1200 may be blow-molded to form the body 110. As shown in FIG. 12, the preform 1200 has the nozzle piece 120 and/or the cap piece 130 from FIG. 5 coupled thereto and/or integral therewith. However, in other embodiments, the preform 1200 may have the nozzle piece 120 and/or the cap piece 130 from FIG. 1 or 8 coupled thereto and/or integral therewith. The preform 1200 may have the nozzle piece 120 and/or the cap piece 130 integral therewith before the blow-molding takes place. In another embodiment, the nozzle piece 120 and/or the cap piece 130 may be coupled to the body 110 after the preform 1200 is blow-molded into the body 110.

What is claimed is:

1. A container, comprising:

a body defining an internal volume and a first opening that provides a path of fluid communication between the internal volume and an exterior of the body;

a nozzle piece positioned at least partially within the first opening in the body, wherein the nozzle piece defines a second opening that is smaller than the first opening in the body, wherein the nozzle piece is coupled to the body via a first hinge; and a cap piece that is integral with the body, wherein the cap piece is configured to pivot between an open position and a closed position via a second hinge that is positioned between the nozzle piece and the cap piece, wherein fluid flow is permitted through the second opening in the nozzle piece when the cap piece is in the open position, and wherein the cap piece prevents fluid flow through the second opening in the nozzle piece when the cap piece is in the closed position;

wherein the nozzle piece is configured to pivot between the open position and the closed position with respect to the body, and the cap piece is configured to pivot between the open position and the closed position with respect to the nozzle piece; and wherein the nozzle piece is configured to pivot in a first direction, wherein the cap piece is configured to pivot in a second direction, and herein the first direction is substantially perpendicular to the second direction.

2. The container of claim 1, wherein the nozzle piece is coupled to the body via a threaded engagement, a friction fit, or a snap fit, optionally the nozzle piece is configured to be removed from the body to introduce a consumer product into the internal volume through the first opening in the body, and wherein the nozzle piece is not coupled to or integral with the cap piece.

3. The container of claim 2, wherein the nozzle piece comprises:

a substantially planar outer surface; and a first protrusion that extends from the substantially planar outer surface, wherein the second opening in the nozzle piece extends through the first protrusion, optionally the cap piece further comprises a second protrusion that extends from the cap piece and is configured to prevent fluid from flowing through the second opening in the nozzle piece when the cap piece is in the closed position.

4. The container of claim 1, wherein the nozzle piece is configured to move together with the cap piece at least partially into the first opening in the body when the cap piece pivots from the open position to the closed position.

5. The container of claim 1, wherein the second hinge breaks allowing the nozzle piece to remain positioned at least partially within the first opening in the body when the cap piece pivots from the closed position back to the open position.

6. The container of claim 1, wherein the body, the nozzle piece, the first hinge, the cap piece, and the second hinge are one integral component.

7. The container of claim 3, wherein the second protrusion comprises a recess, and wherein the protrusion of the nozzle piece is configured to be received in the recess of the second protrusion of the cap piece when the cap piece is in the closed position.

* * * * *